United States Patent [19]

Tully

[11] Patent Number: 5,018,375

[45] Date of Patent: May 28, 1991

[54] LOCKSET HAVING ELECTRIC MEANS FOR DISABLING AND ENABLING THE OUTER HANDLE

[75] Inventor: Clay E. Tully, Charlotte, N.C.

[73] Assignee: Yale Security Inc., Monroe, N.C.

[21] Appl. No.: 584,298

[22] Filed: Sep. 18, 1990

[51] Int. Cl.[5] ..... E05B 55/08

[52] U.S. Cl. ..... 70/472; 70/218; 70/224; 70/277; 70/283; 292/144; 292/DIG. 27

[58] Field of Search ..... 70/218, 223, 224, 283, 70/472, 149, 277, 279; 292/144, DIG. 27

[56] References Cited

U.S. PATENT DOCUMENTS

| | | | |
|---|---|---|---|
| 3,894,417 | 7/1975 | Taniyama | 70/156 |
| 3,939,679 | 2/1976 | Barker et al. | 70/277 |
| 4,073,527 | 2/1978 | Schlage | 292/144 X |
| 4,671,087 | 6/1987 | Olenfalk et al. | 292/DIG. 27 X |
| 4,736,970 | 4/1988 | McGourty et al. | 70/467 X |
| 4,920,773 | 5/1990 | Surko, Jr. | 70/224 |

FOREIGN PATENT DOCUMENTS

| | | | |
|---|---|---|---|
| 355578 | 6/1922 | Fed. Rep. of Germany | 292/DIG. 27 |
| 2303145 | 10/1976 | France | 292/144 |
| 2211239 | 6/1989 | United Kingdom | 70/283 |

*Primary Examiner*—Lloyd A. Gall

*Attorney, Agent, or Firm*—Dallett Hoopes

[57] ABSTRACT

Lockset has within its outer tubular spindle a radial dog which, depending on its position, couples or decouples the spindle and the outer handle. Dog is moved from one position to the other by pin on rotary motor shaft screwing in or out a spring encircling the shaft and attached to dog. Motor is in inner tubular spindle.

6 Claims, 1 Drawing Sheet

10
12
14
16
18
20
22
24
26
28
30
32
34
36
38
40
42
42a
44
46
48
50
60
62
64
66
68
70
72
74
78
3
4
5
K

LOCKSET HAVING ELECTRIC MEANS FOR DISABLING AND ENABLING THE OUTER HANDLE

BACKGROUND OF THE INVENTION

1. Field of the Invention

This invention relates to locks having electric means for disabling and enabling the outer handle of the lock. More specifically, this invention relates to a cylindrical lockset having a rotary electric motor disposed in its inner tubular spindle adapted to disable and enable the outer handle.

2. Description of Related Art including Information Disclosed under §§1.97 to 1.99

In the prior art there are showings of locksets having motor means disposed in the inner spindle for enabling or disabling the outer handle. Invariably these motor means are in the form of solenoids. An example is disclosed in the U.S. Pat. No. 4,736,970 which issued Apr. 12, 1988 to T. K. McGourty et al.

The drawback of such electric solenoid disabling means is that during the period that the solenoid is activated they have consumed a large amount of electric power. Because a sizeable majority of such electrified locksets are components of electronic security systems which are battery powered, high power consumption is unacceptable. The batteries powering such solenoids are often in the form of rechargeable small dry cells mounted within the lock.

SUMMARY OF THE INVENTION

The invention, therefore, is a lockset having a rotary motor capable of operating in either direction to enable or disable the outside handle. The rotary motor is disposed in the tubular inside spindle of the lockset and the extreme outward end of its shaft is received into an opening in a disc formed with a radial dog supported for limited longitudinal movement in the outer tubular spindle. An axial spring has one end connected to the disc and surrounds the shaft. Spaced away from the dog the shaft carries a radial pin which is disposed between adjacent turns of the spring. In operation, the rotation of the motor shaft causes the pin to move the spring along the shaft in effect "screwing" the dog inward or outward of the lock. Depending on its inward or outward position, the dog couples or decouples the outer spindle and the outer handle. The dog bears the same relation to the outer spindle and handle as the dog in another patent of my assignee, namely U.S. Pat. No. 4,920,773.

BRIEF DESCRIPTION OF THE DRAWINGS

Other features and objects of the invention will be apparent to those skilled in the art from the following specification and drawings, all of which disclose a non-limiting form of the invention. In the drawings.

DESCRIPTION OF THE PREFERRED EMBODIMENT

Figures 1, 2, 3, 4, 5:
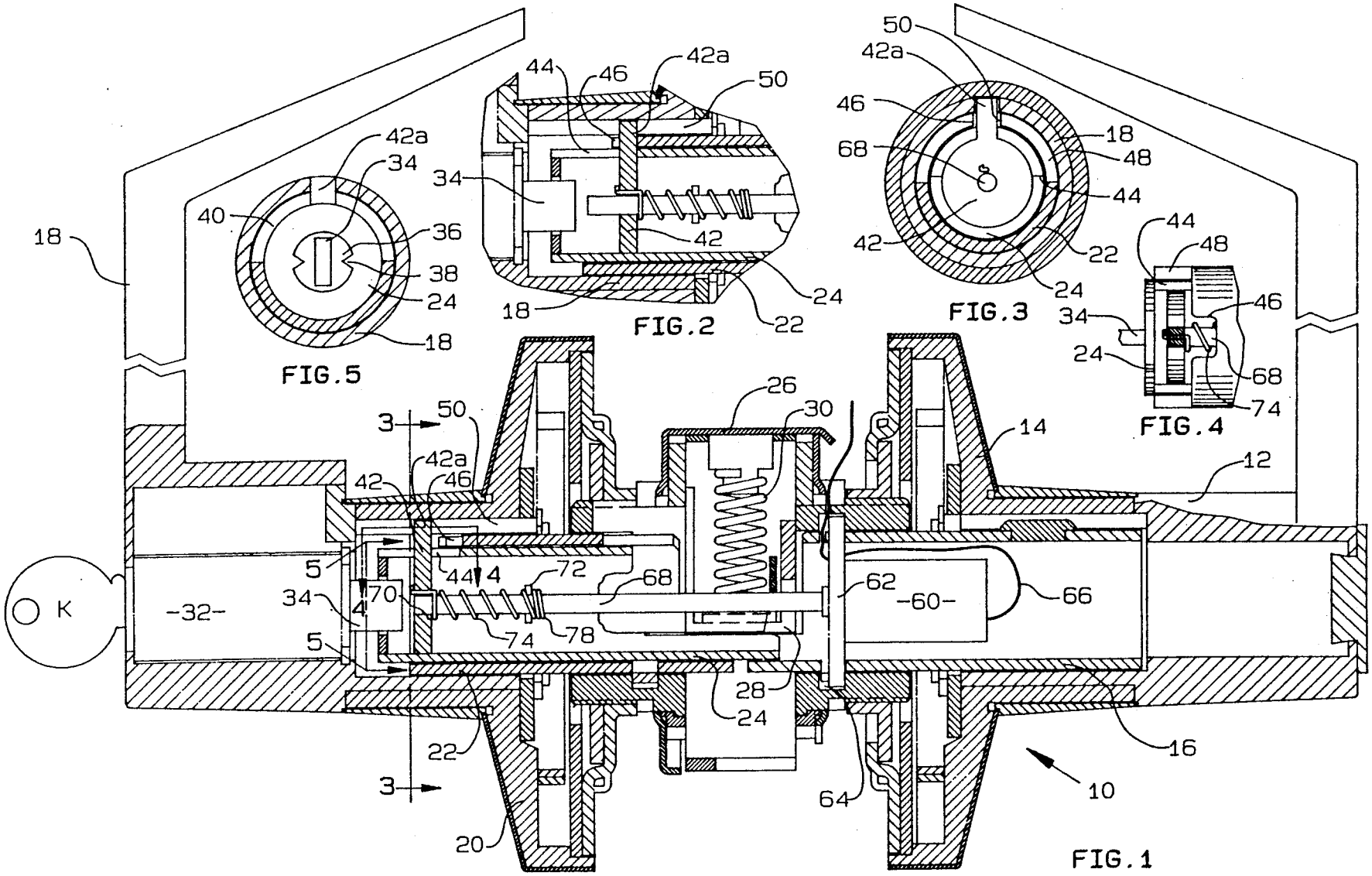
FIG. 1 is a center line section of a lockset embodying the invention showing the dog in the disengaged position.
FIG. 2 is a fragment of FIG. 1 but showing the dog in the engaged condition.
FIG. 3 is a sectional view taken on the line 3—3 of FIG. 1.
FIG. 4 is a sectional view taken on the line 4—4 of FIG. 1.
FIG. 5 is a sectional view taken on the line 5—5 of FIG. 1.

A lockset embodying the invention is generally designated 10 in FIG. 1. It comprises an inside handle 12 rotatably mounted in a rose 14. The handle is keyed to a tubular inner spindle 16.

An outer handle 18 is provided to rotate within the outer rose 20 disposed about a tubular outer spindle 22. A release tube 24 is provided inside the outer spindle.

Between the inner and outer assemblies described above is disposed a cylindrical lockset housing 26 which includes a latch retractor 28 biased by spring 30 with the latch (not shown) in outward position.

The outer handle has a centrally disposed lock cylinder 32 having a tail 34 which fits into an opening 36 in the outward end of the release tube 24. The release tube 24 has inward diametrically opposed points 38 in its leftward end wall 40 (FIG. 1).

Disposed within the release tube 24 and stabilized thereby is a dog disc 42. The disc includes an outward radial dog **42*a* which extends through a window 44** in the release tube.

As described in the aforementioned U.S. Pat. No. 4,920,773, the outer spindle 22 is formed with a notch comprising a longitudinal slot 46 (FIG. 4) and a circumferential opening 48 outward therefrom. Also, as described in the aforementioned patent, the shank of the outer handle 18 is provided with a longitudinal spline 50.

With the dog disc 42 is as shown in FIG. 2, in inward position, the dog is received into the slot 46 as well as in the longitudinal spline or keyway 50, thus coupling together for rotation the outer spindle 22 and the handle 18. When, on the other hand, the disc 42 is in its disabling or outward position shown in FIG. 1, the dog **42*a* is disposed in longitudinal spline 50 but because it is in the circumferential opening 48 (FIG. 4) it is not keyed to the inner spindle. Thus, in this condition (FIG. 1) when the handle 18 is turned, the disc 42 rotates but does not also turn the inner spindle 22** or open the lock. The outer handle is disabled.

Even though the outer handle is disabled as described above, the cylinder 32 in the outer handle is effective to open the lock for as the key K is turned, the cylinder tail 34 engages the points 38 in the end of the release tube 24 causing the tube to rotate and the scoop at the inner end of the release tube 24 to rock and engage the retractor 28 against the bias of the spring 30 to retract the latch.

Mounted within the tubular inner spindle 16 is the motor 60. The leftward end of the motor 60 as shown (FIG. 1) has an outer yoke 62 which fits into appropriate slots in the spindle 16. The ends of the yoke 62 extend into an annular slot 64 in the mounting boss of the housing 26. Wires 66 from the motor 60 lead out of the housing and are connected to the electric controls for the lockset (not shown).

The motor 60 has a leftward shaft 68 (FIG. 1), the remote end of which extends into a central opening 70 in the dog disc 42 and is journaled therein for rotation so that the rotation of the shaft 68 in either direction does not rotate the dog disc 42. Intermediate the disc 42 and the motor 60, the shaft is provided with a transverse pin 72. A wound spiral spring 74 circumposes the shaft 68. The leftward end of the spring is secured to the disc 42 by extending through a tiny aperture in the disc 42 and being clinched over as shown. The opposite end of the spring has a contiguous double winding 78 hugging the shaft on the opposite side of the pin 72 from the dog disc 42. The pin fits between adjacent windings of the spring.

In the operation of the structure thus far described, when it is desired to enable the outside handle 18, the motor 60 is activated by the lock to drive the shaft 68 so that the pin 72 "screws" the spring 74 rightward. In this procedure, the spring acts as a "nut" to the pin 72, the spring 74 held from rotation by the engagement of the dog 42*a* in the spline 50. In actual practice, the powering of the motor so that dog disc 42 moves from the position shown in FIG. 1 to that shown in FIG. 2 may take a cycle time of only 40 milliseconds.

When it is thereafter desired to disengage or disable the outside handle 18, the motor 60 is activated by the lock controls (not shown) to drive the shaft 68 in the opposite direction so that pin 72 "screws" the spring 74 leftward to the position shown in FIG. 1. In this position, the dog 42*a* is outside of the slot 46 so that turning of the handle 18 while it may cause the disc 42 and dog 42*a* to rotate does not transmit that rotation to the outer spindle 22. As with the enabling cycle, the disabling cycle requires that the motor 60 run for no longer than 40 milliseconds.

It will be apparent to those skilled in the art that as compared to the electric power required for a constantly activated solenoid, the power required by the lockset of the invention is nominal, adding substantial life to the lock batteries.

While the invention is shown in the form of an improvement to a so called cylindrical lockset, the features of the invention can also be used with a mortise lock or a tubular lockset. Hence, the invention is not limited to the embodiment shown, rather the invention can be defined as having the scope of the following claim language with additional scope affordable by enlargement of the right to exclude through the application of the doctrine of equivalents.

What is claimed is:

1. A door lock comprising an inner handle, an outer handle, a latch housing between the handles and containing a latch retractor, first spring means biasing the latch retractor outwardly, coaxial inner and outer tubular spindles receiving the respective handles and both terminating respectively inside the lock in arcuate pullback scoops, the two scoops being aligned end-to-end and disposed against the side of the retractor opposite the first spring means and each being adapted when turned to activate the latch retractor, the inner handle being keyed to the inner spindle, the outer spindle being notched out at its outer end, the notch comprising a longitudinal slot and an adjoining partial circumferential space, the outer spindle having thereinside a transversely disposed disc having a central opening and a radial dog, the outer handle having a shank with a longitudinal interior spline, the disc and dog normally disposed with the dog extending through the longitudinal slot and into the spline to key the outer handle and the outer tubular spindle into unitary rotation with each other, and an electrical motor fixedly mounted in the inner tubular spindle, the motor having a central rotary shaft coaxial with the spindles and extending through the retractor and into the central opening in the disc, the shaft having an outward radial pin intermediate the retractor and the disc, an axial spring closely surrounding the shaft and having one end fixed in the disc and the other end embracing the shaft on the far side of the pin from the disc, the pin being disposed between adjacent turns of the spring, whereby, depending on rotary direction, rotation of the motor will drive the disc and dog either into the longitudinal slot to key the outer spindle and shank together or outward into the circumferential space so that the outer handle is disconnected from the outer spindle.

2. A door lock as claimed in claim 1 wherein the outer spindle has within it and outside the disc a release tube which has a peripheral opening in the area of the notch in the outer spindle, the inner end of the release tube terminating in an unlocking scoop disposed inside the scoop of the outer spindle, the outer end having beyond the notch a radial end plate formed with a transverse slot therein and the outer handle has a central lock cylinder having an operator tail received into the slot and adapted when turned to engage and turn the release tube so that the release tube scoop retracts the latch retractor.

3. A door lock as claimed in claim 1 wherein the motor is mounted on a yoke secured in openings in the inner tubular spindle.

4. A door lock as claimed in claim 1 wherein said one end of the spring is fixed to the disc by extending into a hole in the disc and being clinched over.

5. A door lock as claimed in claim 1 wherein the transverse pin extends outward from either side of the shaft.

6. A door lock as claimed in claim 1 wherein the said other end of the spring embraces the shaft by having two contiguous justaposed turns of the spring closely encircling the shaft.

* * * * *